US005264113A

United States Patent [19]

Bartak et al.

[11] Patent Number: 5,264,113

[45] Date of Patent: Nov. 23, 1993

[54] TWO-STEP ELECTROCHEMICAL PROCESS FOR COATING MAGNESIUM ALLOYS

[75] Inventors: Duane E. Bartak, Grand Forks, N. Dak.; Brian E. Lemieux, East Grand Forks, Minn.; Earl R. Woolsey, Grand Forks, N. Dak.

[73] Assignee: Technology Applications Group, Inc., Grand Forks, N. Dak.

[21] Appl. No.: 729,612

[22] Filed: Jul. 25, 1991

[51] Int. Cl.[5] ..... C25D 11/30

[52] U.S. Cl. ..... 205/321; 205/219

[58] Field of Search ..... 205/321, 219

[56] References Cited

U.S. PATENT DOCUMENTS

| | | | |
|---|---|---|---|
| 1,574,289 | 2/1926 | Keeler | 205/321 |
| 3,834,999 | 9/1974 | Hradcovsky et al. | 204/56 |
| 3,956,080 | 5/1976 | Hradcovsky et al. | 204/56 |
| 4,082,626 | 4/1978 | Hradcovsky | 204/56 |
| 4,184,926 | 1/1980 | Kozak | 204/32 |
| 4,620,904 | 11/1986 | Kozak | 205/321 |
| 4,668,347 | 5/1987 | Habermann et al. | 205/321 |
| 4,744,872 | 5/1988 | Kobayashi et al. | 204/58.4 |
| 4,976,830 | 12/1990 | Schmeling et al. | 205/321 |

FOREIGN PATENT DOCUMENTS

| | | |
|---|---|---|
| 58-1093 | 1/1983 | Japan . |
| 58-1094 | 1/1983 | Japan . |
| 62-33783 | 2/1987 | Japan . |
| 62-70600 | 4/1987 | Japan . |
| 63-29000 | 6/1988 | Japan . |
| 63-44839 | 7/1988 | Japan . |
| 63-277793 | 11/1988 | Japan . |

OTHER PUBLICATIONS

Duane E. Bartak, "Electrodeposition and Characteristics of A Silicon-Oxide Coating for Magnesium Alloys", presented Jun. 1991.

*Primary Examiner*—John Niebling
*Assistant Examiner*—Kishor Mayekar
*Attorney, Agent, or Firm*—Merchant, Gould, Smith, Edell, Welter & Schmidt

[57] ABSTRACT

A two-step process for the coating of magnesium and its alloys is disclosed. The first step comprises immersing the magnesium workpiece in a first electrochemical solution comprising about 3 to 10 wt-% of a hydroxide and about 5 to 30 wt-% of a fluoride having a pH of at least about 12. By controlling a current density to about 10 to 200 mA/cm$^2$, an increasing voltage differential is established between an anode comprising the pretreated article and a cathode also in contact with the electrolytic solution. Next, the article is immersed in an aqueous electrolytic solution having a pH of at least about 11 and which solution is prepared from components comprising a water soluble hydroxide, a water soluble fluoride source and a water soluble silicate in amounts to result in an addition of about 2 to 15 g of a hydroxide per liter of solution, about 2 to 14 g of a fluoride per liter of solution and about 5 to 40 g of a silicate per liter of solution. Again, by controlling the current density to about 5 to 100 mA/cm$^2$, an increasing voltage differential of at least about 150 volts is established between an anode comprising the pretreated article and a cathode also in contact with the electrolytic solution. This process results in a superior coating which has increased abrasion and corrosion resistance.

28 Claims, 2 Drawing Sheets

FIG. 3
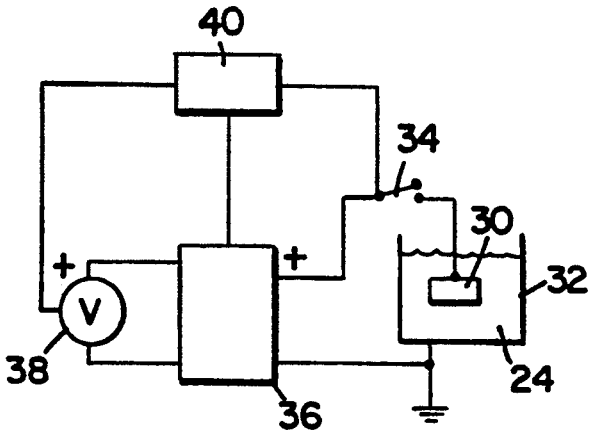
FIG. 1
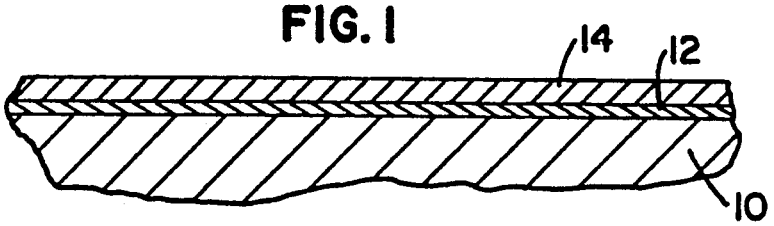
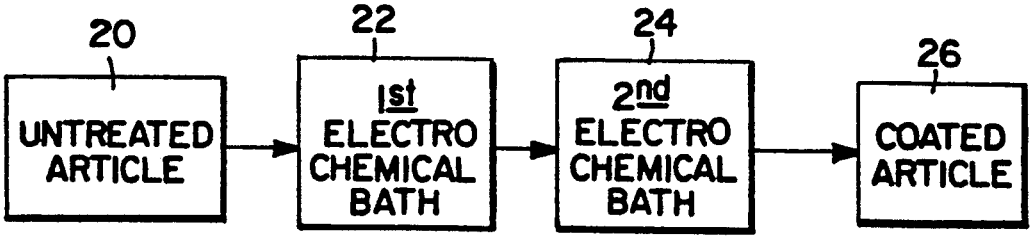
FIG. 2

TWO-STEP ELECTROCHEMICAL PROCESS FOR COATING MAGNESIUM ALLOYS

FIELD OF THE INVENTION

The invention relates to a process for forming an inorganic coating on a magnesium alloy. In particular, the invention relates to a two-step method comprising a first electrochemical treatment in a bath comprising a hydroxide and a fluoride and a second electrochemical treatment in a bath comprising a hydroxide, a fluoride source and a silicate.

BACKGROUND OF THE INVENTION

The use of magnesium in structural applications is growing rapidly. Magnesium is generally alloyed with any of aluminum, manganese, thorium, lithium, tin, zirconium, zinc and rare earth metals or other alloys or combinations of these to increase its structural ability. Such magnesium alloys are often used where a high strength to weight ratio is required. The appropriate magnesium alloy can also offer the highest strength to weight ratio of the ultra light metals at elevated temperatures. Further, alloys with rare earth or thorium can retain significant strength up to temperatures of 315° C. and higher. Structural magnesium alloys may be assembled in many of the conventional manners including riveting and bolting, arc and electric resistance welding, braising, soldering and adhesive bonding. The magnesium-containing articles have uses in the aircraft and aerospace industries, military equipment, electronics, automotive bodies and parts, hand tools and in materials handling. While magnesium and its alloys exhibit good stability in the presence of a number of chemical substances, there is a need to further protect the metal, especially in acidic environments and in salt water conditions. Therefore, especially in marine applications, it is necessary to provide a coating to protect the metal from corrosion.

There are many different types of coatings for magnesium which have been developed and used. The most common coatings are chemical treatments or conversion coatings which are used as a paint base and provide some corrosion protection. Both chemical and electrochemical methods are used for the conversion of magnesium surfaces. Chromate films are the most commonly used surface treatments for magnesium alloys. These films of hydrated, gel-like structures of polychromates provide a surface which is a good paint base but which provide limited corrosion protection.

Anodization of magnesium alloys is an alternative electrochemical approach to provide a protective coating. At least two low voltage anodic processes, Dow 17 and HAE, have been commercially employed. However, the corrosion protection provided by these treatments remains limited. The Dow 17 process utilizes potassium dichromate, a chromium (VI) compound, which is acutely toxic and strictly regulated. Although the key ingredient in the HAE anodic process is potassium permanganate, it is necessary to use a chromate sealant with this coating in order to obtain acceptable corrosion resistance. Thus in either case, chromium (VI) is necessary in the overall process in order to achieve a desirable corrosion resistant coating. This use of chromium (VI) means that waste disposal from these processes is a significant problem.

More recently, metallic and ceramic-like coatings have been developed. These coatings may be formed by electroless and electrochemical processes. The electroless deposition of nickel on magnesium and magnesium alloys using chemical reducing agents in coating formulation is well known in the art. However, this process results in the creation of large quantities of hazardous heavy metal contaminated waste water which must be treated before it can be discharged. Electrochemical coating processes can be used to produce both metallic and nonmetallic coatings. The metallic coating processes again suffer from the creation of heavy metal contaminated waste water.

Non-metallic coating processes have been developed, in part, to overcome problems involving the heavy metal contamination of waste water. Kozak, U.S. Pat. No. 4,184,926, discloses a two-step process for forming an anti-corrosive coating on magnesium and its alloys. The first step is an acidic chemical pickling or treatment of the magnesium work piece using hydrofluoric acid at about room temperature to form a fluoro-magnesium layer on the metal surface. The second step involves the electrochemical coating of the work piece in a solution comprising an alkali metal silicate and an alkali metal hydroxide. A voltage potential from about 150–300 volts is applied across the electrodes, and a current density of about 50–200 mA/cm$^2$ is maintained in the bath. The first step of this process is a straight forward acid pickling step, while the second step proceeds in an electrochemical bath which contains no fluoride source. Tests of this process indicate that there is a need for increased corrosion resistance and coating integrity.

Kozak, U.S. Pat. No. 4,620,904, discloses a one-step method of coating articles of magnesium using an electrolytic bath comprising an alkali metal silicate, an alkali metal hydroxide and a fluoride. The bath is maintained at a temperature of about 5°–70° C. and a pH of about 12–14. The electrochemical coating is carried out under a voltage potential from about 150–400 volts. Tests of this process also indicate that there remains a need for increased corrosion resistance.

Based on the teachings of the prior art, a process for the coating of magnesium-containing articles is needed which results in a uniform coating with increased corrosion resistance. Further, a more economical coating process is needed which has reduced apparatus demands and which does not result in the production of heavy metal contaminated waste water.

SUMMARY OF THE INVENTION

The present invention is directed to a process for coating a magnesium-containing article. The article is first immersed in an aqueous electrolytic solution comprising about 3 to 10 g/L of a hydroxide and about 5 to 30 g/L of a fluoride having a pH of at least about 11. By controlling a current density to about 10 to 200 mA/cm$^2$, an increasing voltage differential is established between an anode comprising the pretreated article and a cathode also in contact with the electrolytic solution. This pretreatment step cleans the article and creates a base layer comprising magnesium oxide, magnesium fluoride, magnesium oxofluoride, or a mixture thereof at the surface of the article. Next, the article is immersed in an aqueous electrolytic solution having a pH of at least about 11 and which solution is prepared from components comprising a water soluble hydroxide, a water soluble fluoride source and a water soluble silicate in amounts to result in an addition of about 2 to 15 g of a hydroxide per liter of solution, about 2 to 14 g of a fluoride per liter of solution and about 5 to 40 g of a silicate per liter of solution. Again by controlling the current density to about 5 to 100 mA/cm$^2$, an increasing voltage differential of at least about 150 volts is established between an anode comprising the pretreated article and a cathode also in contact with the electrolytic solution to produce a spark discharge. Through this process, a silicon oxide-containing coating is formed on the base layer.

In one preferred embodiment, a full wave rectified alternating current power source is used.

The term "magnesium-containing article", as used in the specification and the claims, includes magnesium metal and alloys comprising a major proportion of magnesium.

BRIEF DESCRIPTION OF THE DRAWINGS

FIG. 1 illustrates a cross-section of the coated magnesium-containing article of the present invention.

FIG. 2 is a block diagram of the present invention.

FIG. 3 is a diagram of the electrochemical process of the present invention.

DETAILED DESCRIPTION OF THE PREFERRED EMBODIMENT

Figure 4:
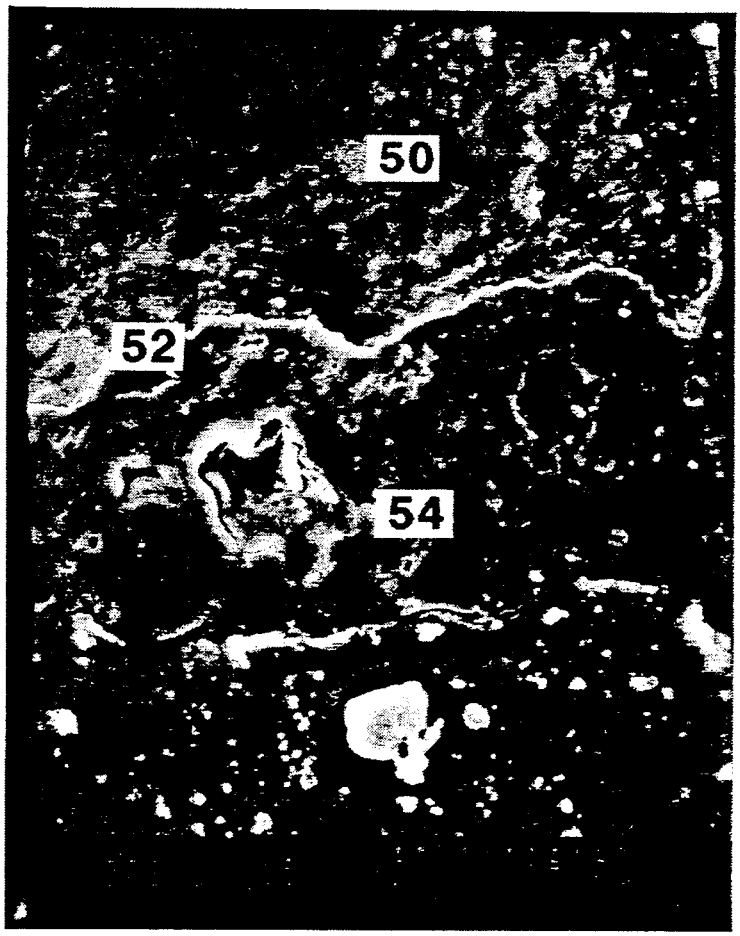
FIG. 4 is a scanning electron photomicrograph of a cross-section through the magnesium-containing substrate and a coating according to the invention.

FIG. 1 illustrates a cross-section of the surface of a magnesium-containing article having been coated using the process of the present invention. The magnesium-containing article 10 is shown with a first inorganic layer 12 comprising magnesium oxide, magnesium fluoride, magnesium oxofluoride, or a mixture thereof and a second inorganic layer 14 comprising silicon oxide. The layers 12 and 14 combine to form a corrosion resistant coating on the surface of the magnesium-containing article.

FIG. 2 illustrates the steps used to produce these coated articles. An untreated article 20 is first treated in a first electrochemical bath 22 which cleans and forms a layer comprising magnesium oxide, magnesium fluoride, magnesium oxofluoride, or a mixture thereof on the article. Next, the article is treated in a second electrochemical bath 24 resulting in the production of a coated article 26.

The article is subjected to a first electrochemical coating process shown in FIG. 3. In the first electrochemical step, the first electrochemical bath 22 comprises an aqueous electrolytic solution comprising about 3 to 10 g/L of a soluble hydroxide compound and about 5 to 30 g/L of a soluble fluoride. Preferred hydroxides include alkali metal hydroxides and ammonium hydroxide. More preferably, the hydroxide is an alkali metal hydroxide, and most preferably, the hydroxide is potassium hydroxide.

The soluble fluoride may be a fluoride such as an alkali metal fluoride, ammonium fluoride, ammonium bifluoride, and hydrogen fluoride. Preferably, the fluoride comprises an alkali metal fluoride, hydrogen fluoride or mixtures thereof. More preferably, the fluoride comprises potassium fluoride.

Compositional ranges for the aqueous electrolytic solution are shown below in Table I.

TABLE I

| Component | Preferred | More Preferred | Most Preferred |
|---|---|---|---|
| Hydroxide (g/L) | 3 to 10 | 5 to 8 | 5 to 6 |
| Fluoride (g/L) | 5 to 30 | 10 to 20 | 12 to 15 |

In both the first and second electrochemical operations, the article 30 is immersed in an electrochemical bath 42 as an anode. The vessel 32 which contains the electrochemical bath 42 may be used as the cathode, or a separate cathode may be immersed in the bath 42. The anode may be connected through a switch 34 to a rectifier 36 while the vessel 32 may be directly connected to the rectifier 36. The rectifier 36, rectifies the voltage from a voltage source 38, to provide a direct current source to the electrochemical bath. The rectifier 36 and switch 34 may be placed in communication with a microprocessor control 40 for purposes of controlling the electrochemical composition. The rectifier provides a pulsed DC signal, which, in a preferred embodiment, is initially under voltage control with a linear increase in voltage until the desired current density is achieved.

The conditions of the electrochemical deposition process are preferably as illustrated below in Table II.

TABLE II

| Component | Preferred | More Preferred | Most Preferred |
|---|---|---|---|
| pH | ≧11 | 12 to 13 | 12.5 to 13 |
| Temperature (°C.) | 5 to 30 | 10 to 25 | 15 to 20 |
| Time (minutes) | up to 8 | 2 to 6 | 2 to 3 |
| Current Density (mA/cm$^2$) | 10 to 200 | 20 to 100 | 40 to 60 |

The magnesium-containing article is maintained in the first electrochemical bath for a time sufficient to clean impurities at the surface of the article and to form a base layer on the magnesium-containing articles. This results in the production of a magnesium-containing article which is coated with a first or base layer, comprising magnesium oxide, magnesium fluoride, magnesium oxofluoride, or a mixture thereof. Too brief a residence time in the electrochemical bath results in an insufficient formation of the first layer and/or insufficient cleaning of the magnesium-containing article. This will ultimately result in reduced corrosion resistance of the coated article. Longer residence times tend to be uneconomical as the process time is increased and the first layer will be thicker than necessary and may even become non-uniform. This base layer is generally uniform in composition and thickness across the surface of the article and provides an excellent base upon which a second, inorganic layer may be deposited. Preferably, the thickness of the first layer is about 0.05 to 0.2 microns.

Although we do not wish to be confined to a particular mechanism for the coating process, it appears that the first electrochemical step is beneficial in that it cleans or oxidizes the surface of the substrate and also provides a base layer which firmly bonds to the substrate. The base layer is compatible with the composition which will form the second layer and provides a good substrate for the adhesion of the second layer. It appears that the base layer comprises magnesium oxide, magnesium fluoride, magnesium oxofluoride, or a mixture thereof which strongly adheres to the metal substrate. It appears that the compatibility of these compounds with those of the second layer permits the deposition of a layer comprising silicon oxide, in a uniform manner, without appreciable etching of the metal substrate. In addition, both the first and second layers may comprise oxides of other metals within the alloy and oxides of the cations present in the electrolytic solution.

The base layer provides a minimum amount of protection to the metal substrate, but it does not provide the abrasion resistance a complete, two-layer coating provides. However, if the silicon oxide-containing layer is applied directly to the metallic substrate without first depositing the base layer, a non-uniform, poorly adherent coating, which has relatively poor corrosion-resistant properties, will result.

Between the first and second electrochemical baths, 22 and 24 respectively, the pretreated article is preferably thoroughly washed with water to remove any contaminants.

The article is then subjected to a second electrochemical coating process as also depicted in FIG. 3 and generally discussed above. The details of the second electrochemical coating step follows. The second electrochemical bath 24 comprises an aqueous electrolytic solution comprising about 2 to 15 g/L of a soluble hydroxide compound, about 2 to 14 g/L of a soluble fluoride containing compound selected from the group consisting of fluorides and fluorosilicates and about 5 to 40 g/L of a silicate. Preferred hydroxides include alkali metal hydroxides and ammonium hydroxide. More preferably, the hydroxide is an alkali metal hydroxide, and most preferably, the hydroxide is potassium hydroxide.

The fluoride containing compound may be a fluoride such as an alkali metal fluoride, hydrogen fluoride, ammonium bifluoride or ammonium fluoride, or a fluorosilicate such as an alkali metal fluorosilicate or mixtures thereof. Preferably, the fluoride source comprises an alkali metal fluoride, an alkali metal fluorosilicate, hydrogen fluoride or mixtures thereof. Most preferably, the fluoride source comprises an alkali metal fluoride. The most preferable fluoride source is potassium fluoride.

The electrochemical bath also contains a silicate. By "silicate", both here in the specification and the claims, we mean silicates, including alkali metal silicates, alkali metal fluorosilicates, silicate equivalents or substitutes such as colloidal silicas, and mixtures thereof. More preferably, the silicate comprises an alkali metal silicate, and most preferably, the silicate is potassium silicate.

From the preceding paragraphs it is apparent a fluorosilicate may provide both the fluoride and the silicate in the aqueous solution. Therefore, to provide a sufficient concentration of fluoride in the bath only about 2 to 14 g/L of a fluorosilicate may be used. On the other hand, to provide a sufficient concentration of silicate, about 5 to 40 g/L of the fluorosilicate may be used. Of course, the fluorosilicate may be used in conjunction with other fluoride and silicate sources to provide the necessary solution concentrations. Further, it is understood that, in an aqueous solution at a pH of at least about 11, the fluorosilicate will hydrolyze to provide fluoride ion and silicate in the aqueous solution.

Compositional ranges for the aqueous electrolytic solution are shown below in Table III.

TABLE III

| Component | Preferred | More Preferred | Most Preferred |
|---|---|---|---|
| Hydroxide (g/L) | 2 to 15 | 4 to 9 | 5 to 6 |
| Fluoride Source (g/L) | 2 to 14 | 6 to 12 | 7 to 9 |
| Silicate (g/L) | 5 to 40 | 10 to 25 | 15 to 20 |

The conditions of the electrochemical deposition process are preferably as illustrated below in Table IV.

TABLE IV

| Component | Preferred | More Preferred | Most Preferred |
|---|---|---|---|
| pH | ≧11 | 11.5 to 13 | 12 to 13 |
| Temperature (°C.) | 5 to 35 | 10 to 30 | 15 to 25 |
| Time (minutes) | 5 to 90 | 10 to 40 | 15 to 30 |
| Current Density ($mA/cm^2$) | 5 to 100 | 5 to 60 | 5 to 30 |

These reaction conditions allow the formation of an inorganic coating of up to about 40 microns in about 90 minutes or less. Maintaining the voltage differential for longer periods of time will allow for the deposition of thicker coatings. However, for most practical purposes, coatings of about 10 to 30 microns in thickness are preferred and can be obtained through a coating time of about 10 to 30 minutes.

In the second electrochemical bath, the coating is formed through a spark discharge process. The current density applied through the electrochemical solutions establishes an increasing voltage differential, especially at the surface of the magnesium-containing anode. A spark discharge is established across the surface of the anode during the formation of the coating. Under reduced light conditions, the spark discharge is visible to the eye. Of course, as the coating increases in thickness, its resistance increases, and to maintain a given current density, the voltage must increase. Similar sparking procedures are disclosed in Hradcovsky et al., U.S. Pat. Nos. 3,834,999 and 3,956,080, both of which are hereby incorporated by reference.

The second coating produced according to the above-described process is ceramic-like and has excellent corrosion and abrasion resistance and hardness characteristics. While not wishing to be held to this mechanism, it appears that these properties are the result of the morphology and adhesion of the base and the second coating to the metal substrate and the base coating, respectively. It also appears that the preferred second coating comprises a mixture of fused silicon oxide and fluoride along with an alkali metal oxide, most preferably, this second coating is predominantly silicon oxide. "Silicon oxide" here includes any of the various forms of silicon oxide.

The superior coating of the invention is produced without a need for chromium (VI) in the process solutions. Therefore, there is no need to employ costly procedures to remove this hazardous heavy metal contaminant from process waste. As a result, the preferred coatings are essentially chromium (VI)-free.

The adhesion of the coating of the invention appears to perform considerably better than any known commercial coating. This is the result of coherent interfaces between the metal substrate, base coating, and second coating. A scanning electron photomicrograph cross-section view of the coating on the metal substrate is shown in FIG. 4. The photomicrograph show that the metal substrate 50 has an irregular surface at high magnification, and a coherent base layer 52 is formed at the surface of the substrate 50. The silicon oxide-containing layer 54 which is formed on the base layer 52 shows excellent integrity, and both coating layers 52 and 54 therefore provide superior corrosion resistant and abrasion resistant surface.

Abrasion resistance was measured according to Federal Test Method Standard No. 141C, Method 6192.1. Preferably coatings produced according to the invention having thickness of 0.8 to 1.0 mil will withstand at least 1000 wear cycles before the appearance of bare metal substrate using a 1.0 kg load on CS-17 abrading wheels. More preferably, the coating will withstand at least 2000 wear cycles before the appearance of the metal substrate, and most preferably, the coating will withstand at least 3000 wear cycles using a 1.0 kg load on CS-17 abrading wheels.

Corrosion resistance was measured according to ASTM standard methods. Salt fog test, ASTM B117, was employed as the method for corrosion resistance testing with ASTM D1654, procedures A and B used in the evaluation of test samples. Preferably, as measured according to procedure B, coating on magnesium alloy AZ91D produced according to the invention achieve a rating of at least 9 after 24 hours in salt fog. More preferably, the coatings achieve a rating of at least 9 after 100 hours, and most preferably, at least 8 after 200 hours in salt fog.

After the magnesium-containing articles have been coated according to the present process, they may be used as is, offering very good corrosion resistant properties, or they may be further sealed using an optional finish coating such as a paint or sealant. The structure and morphology of the silicon oxide-containing coating readily permit the use of a wide number of additional finish coatings which offer further corrosion resistance or decorative properties to the magnesium-containing articles. Thus, the silicon oxide-containing coating provides an excellent paint base having excellent corrosion resistance and offering excellent adhesion under both wet and dry conditions, for instance, the water immersion test, ASTM D3359, test method B. Any paint which adheres well to glass or metallic surfaces may be used as the optional finish coating. Representative, nonlimiting inorganic compositions for use as an outer coating include additional alkali metal silicates, phosphates, borates, molydates, and vanadates. Representative, nonlimiting organic outer coatings include polymers such as polyfluoroethylene and polyurethanes. Additional finish coating materials will be known to those skilled in the art. Again, these optional finish coatings are not necessary to obtain very good corrosion resistance; however, their use may achieve a more decorative finish or further improve the protective qualities of the coating.

Excellent corrosion resistance occurs after further application of an optional finish coating. Preferably, as measured according to procedure B, coatings produced according to the invention, having an optional finish coating, achieve a rating of at least about 8 after 700 hours in salt fog. More preferably, the coatings achieve a rating of at least about 9 after 700 hours, and most preferably, at least about 10 after 700 hours in salt fog.

EXAMPLES

The following specific examples, which contain the best mode, can be used to further illustrate the invention. These examples are merely illustrative of the invention and do not limit its scope.

EXAMPLE I

Magnesium test panels (AZ91D alloy) were cleaned by immersing them in an aqueous solution of sodium pyrophosphate, sodium borate, and sodium fluoride at about 70° C. and a pH of about 11 for about 5 minutes. The panels were then placed in a 5% ammonium bifluoride solution at 25° C. for about 5 minutes. The panels were rinsed and placed in the first electrochemical bath, which contained potassium fluoride and potassium hydroxide. The first electrochemical bath was prepared by dissolving 5 g/L of potassium hydroxide and 17 g/L of potassium fluoride and has a pH of about 12.7. The panels were then placed in the bath and connected to the positive lead of a rectifier. A stainless steel panel served as the cathode and was connected to the negative lead of the rectifier capable of delivering a pulsed DC signal. The power was increased over a 30 second period with the current controlled to a value of 80 mA/cm$^2$. After 2 minutes, the magnesium oxide/fluoride layer was approximately one to two microns thick. The panels were then taken out of the first electrochemical bath, rinsed well with water, and placed into the second electrochemical bath and connected to the positive lead of a rectifier. The second electrochemical bath was prepared by mixing together potassium silicate, potassium fluoride, and potassium hydroxide. The second electrochemical bath was made by first dissolving 150 g of potassium hydroxide in 30 L of water. 700 milliliters of a commercially available potassium silicate concentrate (20% w/w $SiO_2$) was then added to the above solution. Finally 150 g of potassium fluoride was added to the above solution. The bath had a pH of about 12.7 and a concentration of 5 g/L potassium hydroxide, about 18 g/L potassium silicate and about 5 g/L potassium fluoride. A stainless steel panel served as the cathode and was connected to the negative lead of a rectifier capable of delivering a pulsed DC signal. The voltage was increased over a 30 second period to approximately 150 V, and then the current was adjusted to sustain a current density of 25 mA/cm$^2$. After approximately 30 minutes, the coating was approximately 25 microns thick.

EXAMPLES II-VIII

Examples II-VII were prepared according to the process of Example I with the quantities of components as shown in Tables V and VIII shown below.

TABLE V

| Electrochemical Bath #1 (30 L) | | | | | |
|---|---|---|---|---|---|
| Example | Hvdroxide | Fluoride | pH | Current Density (mA/cm$^2$) | Time (min.) |
| II | 180 g KOH | 450 g KF | 12.8 | 50 | 2 |
| III | 120 g NaOH | 310 g NaF | 12.7 | 60 | 1.5 |
| IV | 150 g KOH | 500 g KF | 12.7 | 80 | 2 |
| V | 90 g LiOH | 500 g KF | 12.6 | 70 | 1.5 |
| VI | 180 g KOH | 560 g KF | 12.8 | 80 | 1 |
| VII | 135 g NaOH | 250 g LiF | 12.8 | 70 | 2 |
| VIII | 150 g KOH | 550 g KF | 12.7 | 80 | 1.5 |

TABLE VI

| Example | Hydroxide | Electrochemical Bath #2 (30 L) Potassium Silicate Concentrate* | Fluoride | pH | Current Density ($mA/cm^2$) | Time (min.) |
|---|---|---|---|---|---|---|
| II | 180 g KOH | 600 mL | 250 g KF | 12.8 | 30 | 30 |
| III | 150 g KOH | 700 mL | 300 g KF | 12.7 | 40 | 20 |
| IV | 120 g NaOH | 600 mL | 300 g KF | 12.7 | 30 | 25 |
| V | 80 g LiOH | 500 mL | 250 g KF | 12.6 | 20 | 25 |
| VI | 150 g KOH | 600 mL | 200 g NaF | 12.7 | 30 | 20 |
| VII | 180 g KOH | 800 mL | 350 g KF | 12.8 | 30 | 30 |
| VIII | 140 g NaOH | 600 mL | 250 g NaF | 12.8 | 40 | 20 |

*20% $SiO_2$ (w/w) in water. In other words, the concentration can be characterized as the equivalent of 20 wt-% $SiO_2$ in water.

Wear resistance or abrasion testing (Federal Method, 141C) of these panels resulted Taber Wear Index (TWI) of less than 15 and in wear cycles of at least about 2000 cycles before the appearance of the metal substrate using a 1.0 kg load on CS-17 abrading wheels.

EXAMPLE IX

A magnesium test panel was coated as in Example I. Upon drying an optional coating was applied in the following manner. The panel was immersed in a 20% (v/v) solution of potassium silicate (20% $SiO_2$, (w/w)) for 5 minutes at 60° C. The panel was rinsed and dried and subjected to salt fog ASTM B117 testing. The panel achieved a rating of 10 (ASTM D1654) after 700 hours in the salt fog.

What is claimed is:

1. A process for forming an improved corrosion resistant coating on a magnesium-containing article, which process comprises:

(a) placing the article into a first, silicate-free, aqueous electrolytic solution having a pH of at least about 11 which comprises:

(i) about 3 to 10 g/L of an aqueous soluble hydroxide; and (i) about 5 to 30 g/L of an aqueous soluble fluoride;

(b) establishing a current density of about 10 to 200 $mA/cm^2$, to produce an increasing voltage differential up to about 180 V between a first anode comprising the article and a first cathode in the electrolytic solution to result in a substantially continuous first layer at the surface of the article, which layer comprises a fluoride, an oxide, an oxofluoride or a mixture thereof, to form a pretreated article;

(c) placing the pretreated article into a second aqueous electrolytic solution having a pH of at least about 11 which comprises a solution prepared from components comprising:

(i) about 2 to 15 g/L of an aqueous soluble hydroxide;

(ii) about 2 to 14 g/L of an aqueous soluble fluoride source; and (iii) about 5 to 40 g/L of an alkali metal silicate;

(d) establishing a current density of about 5 to 100 $mA/cm^2$ to create a voltage differential of at least about 150 V between a second anode comprising the pretreated article and a second cathode in the electrolytic solution under conditions producing a spark discharge;

wherein a silicon oxide-containing coating is formed on the article.

2. The process of claim 1 wherein the pH of step (a) is about 11 to 13.

3. The process of claim 1 wherein the hydroxide of step (a) comprises an alkali metal hydroxide.

4. The process of claim 1 wherein the fluoride of step (a) is selected from the group consisting of sodium fluoride, potassium fluoride, hydrofluoric acid, lithium fluoride, and a mixture thereof.

5. The process of claim 1 wherein the temperature of the first solution is about 5° to 30° C.

6. The process of claim 1 wherein the voltage differential of step (b) is less than about 150 V.

7. The process of claim 1 wherein the current density of step (b) is about 20 to 100 $mA/cm^2$.

8. The process of claim 1 further comprising connecting the first anode and cathode to a first power source.

9. The process of claim 8 wherein the first power source is a rectified alternating current power source.

10. The process of claim 9 wherein the rectified alternating current power source is a full wave rectified power source.

11. The process of claim 1 wherein the pH of step (c) is about 11 to 13.

12. The process of claim 1 wherein the hydroxide of step (c) comprises an alkali metal hydroxide.

13. The process of claim 1 wherein the fluoride source of step (c) is selected from the group consisting of alkali metal fluorides, alkali metal fluorosilicates, hydrogen fluorides, and a mixture thereof.

14. The process of claim 13 wherein the fluoride of step (c) is selected from the group consisting of sodium fluoride, potassium fluoride, hydrogen fluoride acid, lithium fluoride, and a mixture thereof.

15. The process of claim 13 wherein the fluorosilicate of step (c) is selected from the group consisting of potassium fluorosilicate, sodium fluorosilicate, lithium fluorosilicate, and a mixture thereof.

16. The process of claim 1 wherein the silicate of step (c) is selected from the group consisting of sodium silicate, potassium silicate, lithium silicate, sodium fluorosilicate, potassium fluorosilicate, lithium fluorosilicate and a mixture thereof.

17. The process of claim 1 wherein the temperature of the second solution is about 5° to 35° C.

18. The process of claim 1 wherein the current density of step (d) is about 5 to 60 $mA/cm^2$.

19. The process of claim 1 further comprising connecting the second anode and cathode to a second power source.

20. The process of claim 19 wherein the second power source is a rectified alternating current power source.

21. The process of claim 20 wherein the rectified alternating current power source is a full wave rectified power source.

22. The process of claim 1 further comprising sealing the silicon oxide-containing coating.

23. The process of claim 22 wherein the silicon oxide-containing coating is sealed with an inorganic coating.

24. The process of claim 22 wherein the silicon oxide-containing coating is sealed with an organic coating.

25. The process of claim 1, which process is substantially free of chromium (VI).

26. A magnesium-containing substrate coated according to the process of claim 1.

27. A process which is substantially free of chromium (VI) for forming an improved corrosion resistant coating on a magnesium-containing article, which process comprises:

(a) placing the article into a first, silicate-free, aqueous electrolytic solution having a pH of about 13 and a temperature of about 20° C. which comprises:
  (i) about 6 g/L of an aqueous soluble hydroxide; and
  (ii) about 13 g/L of an aqueous soluble fluoride;

(b) connecting a first anode comprising the article and a first cathode to a full wave rectified power source;

(c) establishing a current density of about 50 $mA/cm^2$, to produce an increasing voltage differential up to about 180 V between a first anode comprising the article and a first cathode in the electrolytic solution to result in a substantially continuous first layer at the surface of the article, which layer comprises a fluoride, an oxide, an oxofluoride or a mixture thereof, to form a pretreated article;

(d) placing the pretreated article into a second aqueous electrolytic solution having a pH of about 13 and a temperature of about 20° C. which comprises a solution prepared from components comprising:
  (i) about 6 g/L of an aqueous soluble hydroxide;
  (ii) about 10 g/L of an aqueous soluble fluoride source; and
  (iii) about 15 g/L of an alkali metal silicate;

(e) connecting a second anode comprising the pretreated article and a second cathode to a full wave rectified power source;

(f) establishing a current density of about 30 $mA/cm^2$ to create a voltage differential of at least about 150 V between a second anode comprising the pretreated article and a second cathode in the electrolytic solution under conditions producing a spark discharge;

wherein a silicon oxide-containing coating is formed on the article.

28. A process for forming an improved corrosion resistant coating on a magnesium-containing article, which process comprises:

(a) placing the article into a first, silicate-free, aqueous electrolytic solution having a pH of at least about 11 which comprises:
  (i) about 3 to 10 g/L of an aqueous soluble hydroxide; and
  (ii) about 5 to 30 g/L of an aqueous soluble fluoride;

(b) establishing a current density of about 10 to 200 $mA/cm^2$, to produce an increasing voltage differential up to about 180 V between a first anode comprising the article and a first cathode in the electrolytic solution to result in a substantially continuous first layer at the surface of the article, which layer comprises a fluoride, an oxide, an oxofluoride or a mixture thereof, to form a pretreated article;

(c) placing the pretreated article into a second aqueous electrolytic solution having a pH of at least about 11 which comprises a solution prepared from components comprising:
  (i) about 2 to 15 g/L of an aqueous soluble hydroxide;
  (ii) about 5 to 40 g/L of an aqueous soluble fluorosilicate;

(d) establishing a current density of about 5 to 100 $mA/cm^2$ to create a voltage differential of at least about 150 V between a second anode comprising the pretreated article and a second cathode in the electrolytic solution under conditions producing a spark discharge;

wherein a silicon oxide-containing coating is formed on the article.

* * * * *

UNITED STATES PATENT AND TRADEMARK OFFICE

CERTIFICATE OF CORRECTION

PATENT NO. : 5,264,113

DATED : November 23, 1993

INVENTOR(S) : Duane E. Bartak et al.

It is certified that error appears in the above-identified patent and that said Letters Patent is hereby corrected as shown below:

On column 7, line 1, please delete "show" and substitute therefore --shows--

On column 9, line 40, please delete "(i)" and substitute therefore --(ii)--

On column 10, line 48, please delete "(e)" and substitute therefore --(c)--

Signed and Sealed this

Twenty-fourth Day of May, 1994

*Attest:*

Bruce Lehman

BRUCE LEHMAN

*Attesting Officer*

*Commissioner of Patents and Trademarks*